United States Patent [19]

Colen

[11] Patent Number: 5,056,289

[45] Date of Patent: Oct. 15, 1991

[54] WALL CONSTRUCTION AND SPACER FOR USE THEREWITH

[76] Inventor: William J. Colen, 11248 Jamestown, Dallas, Tex. 75230

[21] Appl. No.: 553,176

[22] Filed: Jul. 13, 1990

[51] Int. Cl.[5] ..... E04B 1/02

[52] U.S. Cl. ..... 52/564; 52/712

[58] Field of Search ..... 52/562, 564, 286, 712–716, 52/378, 379

[56] References Cited

U.S. PATENT DOCUMENTS

| | | | |
|---|---|---|---|
| 783,470 | 2/1905 | Schreck | 52/714 |
| 901,833 | 10/1908 | Rettig . | |
| 949,527 | 2/1910 | Ensminger et al. . | |
| 963,776 | 7/1910 | Kosack | 52/715 |
| 963,778 | 7/1910 | Kosack | 52/713 |
| 1,052,670 | 2/1913 | Francis | 52/714 |
| 1,503,931 | 8/1924 | Wightman . | |
| 1,968,393 | 7/1934 | Henderson | 72/41 |
| 3,696,576 | 10/1972 | Monteiro de Barros | 52/747 |
| 4,062,159 | 12/1977 | Pahr | 52/421 |
| 4,696,140 | 9/1987 | Marshall | 52/442 |
| 4,774,793 | 10/1988 | Mayer | 52/308 |

*Primary Examiner*—James L. Ridgill, Jr.
*Attorney, Agent, or Firm*—David H. Judson

[57] ABSTRACT

The present invention describes a unique wall construction and spacer for use by unskilled labor in such construction. Preferably, the wall comprises a plurality of blocks arranged in layers one above the other, each of the blocks having an exterior face, an interior face, a top and a bottom, the top and bottom of each block having a longitudinal groove therein aligned with the grooves of adjacent blocks. The spacer comprises a base supported against the interior faces of adjacent blocks, and first and second arms extending transversely from the base and supported against the tops of said adjacent blocks. The arms are preferably cut-out portions of the base. Each arm includes at its distal end a tab projecting transversely from the arm and having first and second portions, the first portion for extending downwardly into the groove of a block underlying the arm and the second portion for extending upwardly into the groove of the block overlying the arm.

14 Claims, 2 Drawing Sheets

WALL CONSTRUCTION AND SPACER FOR USE THEREWITH

TECHNICAL FIELD

The present invention relates generally to construction of brick walls and more particularly to a novel spacer for use in such construction to facilitate correct alignment of the bricks even by unskilled laborers.

BACKGROUND OF THE INVENTION

Masonry construction techniques are well-known in the art. Such techniques, however, are impractical for many building projects due to the high cost of labor and materials. Additionally, because mortar must be applied by hand to each brick and the brick must be properly aligned with the bricks already in place, a high degree of skill is required to provide an aesthetically-pleasing result. Such results are extremely difficult to achieve with unskilled labor.

There have been attempts in the prior art to provide systems for assisting a laborer to properly aligning the bricks of a wall construction. Such systems are described in U.S. Pat. Nos. 2,172,816 and 3,170,267 to Douglas et al and Rosenfeld, respectively. In Douglas et al, for example, a plurality of T-shaped dowel plates are supported in aligned grooves along at least three edges of each brick. Rosenfeld describes a system wherein rod-like members are provided for vertical alignment with cross bars between such members for horizontal alignment.

While such systems do provide improvements over manual techniques for aligning bricks in a wall construction, they do not adequately solve the problems associated with the use of unskilled labor. Moreover, the complexity of such systems make them difficult to use in practice and often more expensive than the cost of labor and materials. Such systems also do not reliably stabilize the bricks against lateral movement.

There is therefore a need to provide an improved wall construction technique that overcomes these and other problems associated with the prior art.

BRIEF SUMMARY OF THE INVENTION

It is an object of the present invention to provide a method for constructing a brick wall using unskilled labor.

It is yet another object of the present invention to describe a method for constructing a brick wall that utilizes a plurality of inexpensive yet reliable alignment spacers.

It is a further object of the invention to provide a novel spacer construction for use by unskilled laborers in the construction of a brick wall.

It is yet a further object of the present invention to describe a brick wall construction comprising a plurality of bricks arranged in layers one above the other, and a plurality of simple-to-use spacers to aid in the construction of the wall.

It is a another object of the invention to provide a brick wall construction technique that is simple to implement and results in significant labor cost savings over prior art techniques.

These and other objects of the invention are provided in a wall construction for a building or the like. The wall comprises a plurality of blocks, e.g., bricks, arranged in layers one above the other, each of the blocks having an exterior face, an interior face, a top and a bottom. The top and bottom of each block preferably has a longitudinal groove therein aligned with the grooves of adjacent blocks. According to the invention, a plurality of spacers are also provided and arranged between adjacent blocks to assist the laborer in aligning the blocks in horizontal, vertical and lateral planes to insure that the constructed wall presents an aesthetically-pleasing appearance. In the preferred embodiment, each spacer has a base adapted for support against the interior faces of adjacent blocks, and first and second arms extending transversely from the base and adapted for support against the tops of the adjacent blocks. Each arm includes at its distal end a tab having first and second portions, the first portion extending downwardly into the groove of a block underlying the arm and the second portion extending upwardly into the groove of the block overlying the arm.

Preferably, the spacers are formed of a suitable rigid material such as steel, although other suitable materials such as impact-resistant cardboard or the like may also be used. In the preferred embodiment, the first and second arms are cut-out portions of the base, and each arm of the spacer is sized to correspond to a desired height of a mortar joint between successive layers of the wall. The spacers are also useful at a corner of the wall. In particular, a corner spacer includes a line of weakness along a mid-portion of the spacer to enable it to be bent into first and second substantially transverse sections.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
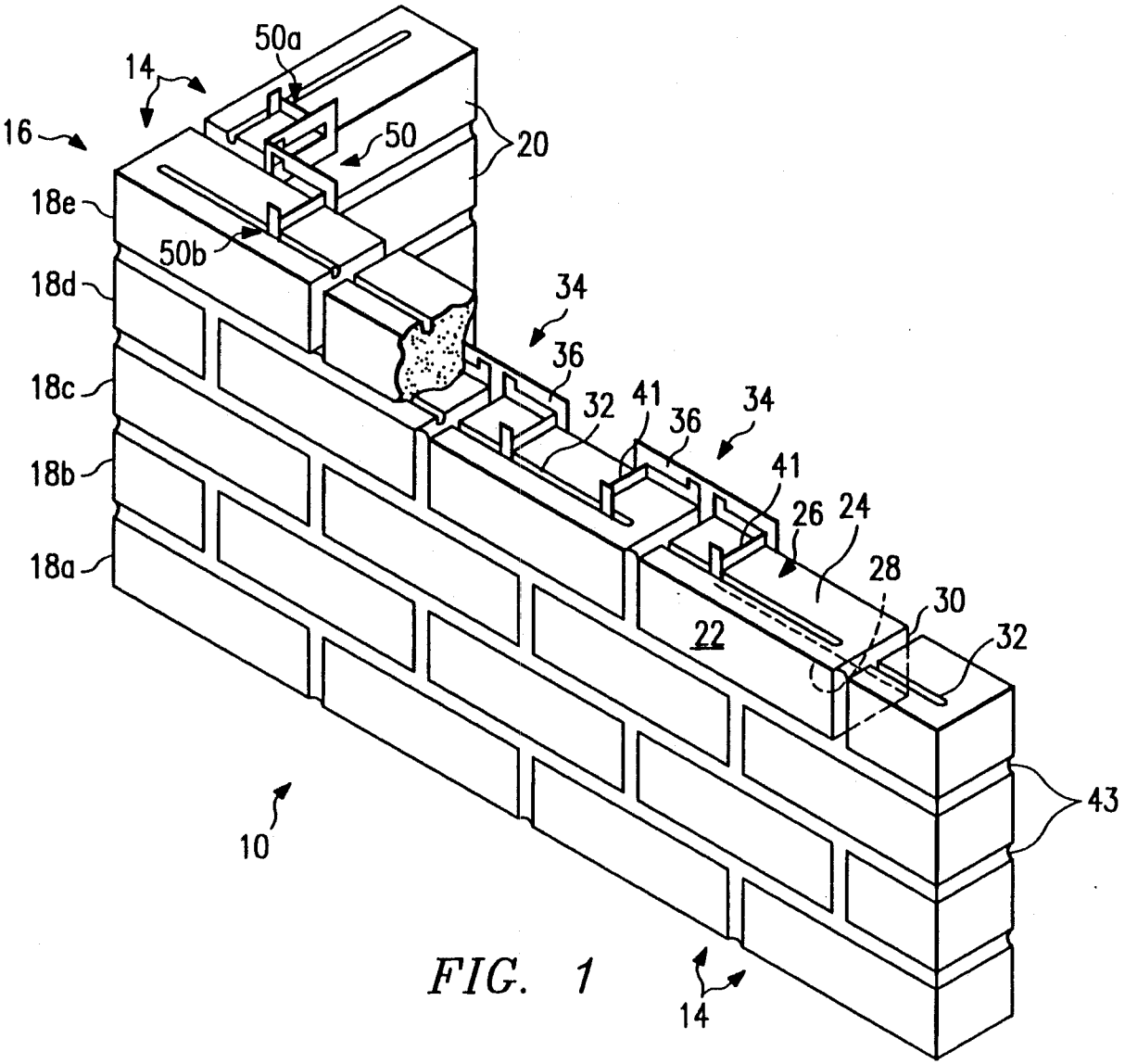
FIG. 1 is a perspective view of a brick wall construction according to the present invention wherein a plurality of spacers are used to facilitate alignment of the bricks by laborers.

Referring now to FIG. 1, a novel wall construction 10 is shown and includes a front portion 12 and a side portion 14 defining a corner 16. The wall comprises a plurality of blocks 20 arranged in layers **18*a*–18*e*** one above the other, each of the blocks having an exterior face 22, an interior face 24, a top 26, a bottom 28 and sides 30. Each of the blocks is preferably a brick, although it should be appreciated that the teachings of this invention are applicable to any wall construction using blocks and not merely brick walls. The top 26 and bottom 28 of each block 20 preferably includes an alignment means such as a longitudinally-extending groove or notch 32. As seen in FIG. 1, the grooves 32 are aligned with the grooves of adjacent blocks. While the use of longitudinal grooves is preferred, it should also be appreciated that each brick can alternatively incorporate other types of alignment means. For example, conventional clay bricks typically are manufactured with one or more transverse holes throughout the mid-section of each brick. Such holes are useful as the alignment means as will be described in more detail below.

Figure 2:
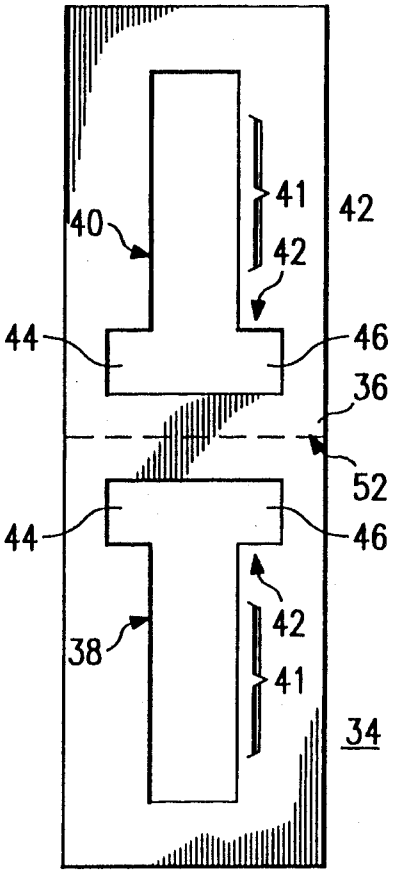
FIG. 2 is a top view of one of the spacers of FIG. 1 showing the flattened construction thereof prior to separation of the support arms from the base thereof.
Figure 3:
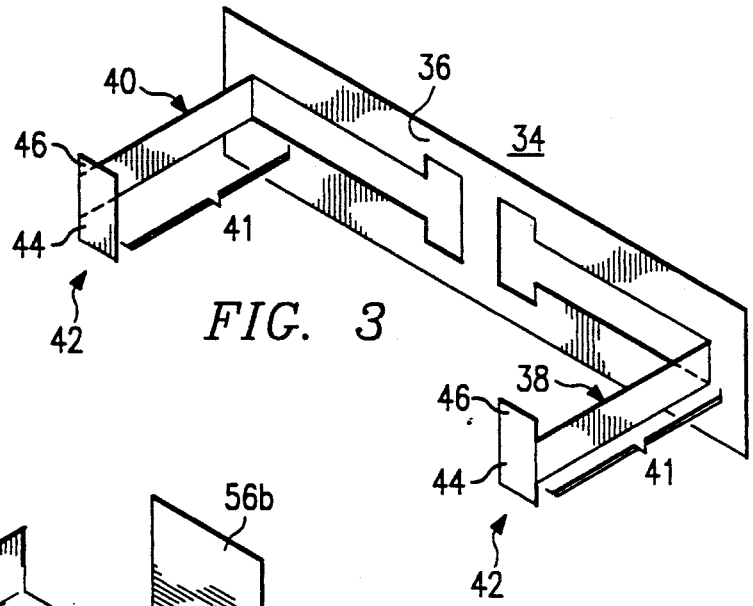
FIG. 3 is a perspective view of the spacer of FIG. 2 with the support arms extended away from the base.

According to the invention, a plurality of spacers 34 are arranged between adjacent blocks for the purpose of facilitating the proper alignment of the blocks during construction of the wall. Referring simultaneously to FIGS. 2 and 3, each of the spacers is preferably formed in a flat profile and includes a base 36 having first and second support arms 38 and 40 integrally-formed therein. The support arms 38 and 40 are adapted to be cut-out from the remainder of the base 36 in the manner shown in FIG. 3 to enable the spacer to be used in the wall construction. Each support arm preferably includes at its distal end a tab 42 having first and second portions 44 and 46.

In operation, each of the support arms 38 and 40 is extended substantially transversely from the base and the tab 42 is then itself turned substantially transversely with respect to the arm such that the tab is substantially parallel to the base. This structure can be effected by the manufacturer or, alternatively, by the laborer at the jobsite. The resulting spacer construction is best seen in FIG. 3. Alternatively, the spacer can be formed with or without cut-out portions using arms secured to the base by welding, hinges, fasteners or the like. The major portion 41 of each arm has a predetermined height equal to the desired height (approximately ⅜ths of an inch) of the mortar joint 43 between successive layers 18 of the brick wall.

Referring now back to FIG. 1, the major portions 41 of the first and second arms are supported against the tops 26 of adjacent blocks, and the base 36 is advantageously supported against the interior faces 24 of the adjacent blocks. This spacer structure and placement provides horizontal, vertical and lateral stabilization of each brick as the brick is placed in its proper position on the wall. In particular, the first portion 44 extends downwardly into the groove of a block underlying the arm and the second portion 46 extends upwardly into the groove of the block overlying the arm.

The spacer of FIG. 3 is preferably formed of steel, aluminum or other metals. Suitable other materials include impact resistant cardboard, composites or rigid plastics. The spacer has significant advantages over the prior art. It is simple and inexpensive to manufacture and provides a reliable tool for assisting even unskilled laborers to construct a brick wall. The spacer is designed to remain in the wall upon use. Each spacer is formed in a flat profile and the spacers can be easily transported to the jobsite and stored for subsequent use. Moreover, the use of the cut-out support arms as described above is especially advantageous because the voids left by the cut-outs facilitate the removal of excess mortar in the mortar joint 43 when the overlying brick is placed on the spacer. Without these voids, excess mortar would be forced forwards toward the exterior face and would be difficult to remove properly without extensive effort by the laborer.

As also seen in FIG. 1, a corner spacer 50 is provided by manufacturing the spacer with a transverse line of weakness 52 as shown in FIG. 2 in phantom. This line of weakness enables the spacer to be bent into first and second transverse sections 50*a* and 50*b*.

Although not shown in detail in FIGS. 2 and 3, it should be appreciated that the structure of the tab 42 can be suitably changed to cooperate with the various types of alignment means in the top and bottom of each brick. As discussed above, for example, if clay bricks are used for the blocks, each tab has a semi-circular structure to mate with the transverse holes extending through the brick. Of course, the exact placement of the longitudinal groove or other alignment means in each brick is not critical although preferably such grooves are located adjacent the exterior face of the brick such that the weight of the overlying brick is distributed along a relatively long support arm.

Figure 4:
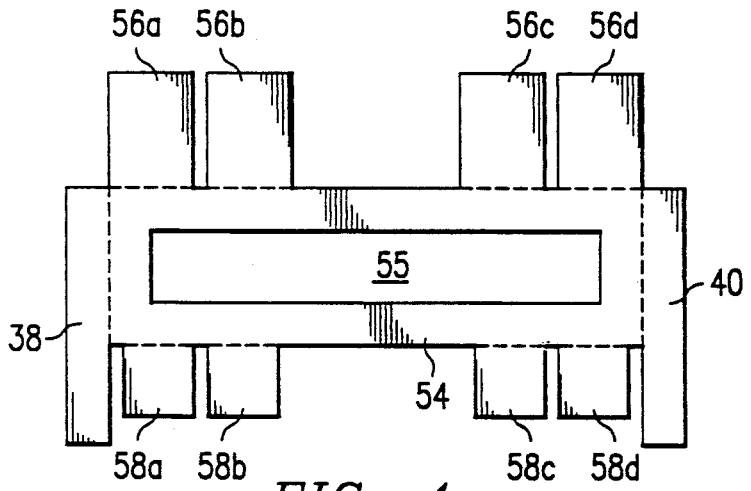
FIG. 4 is a top view of an alternate embodiment of the spacer in its flattened form.
Figure 5:
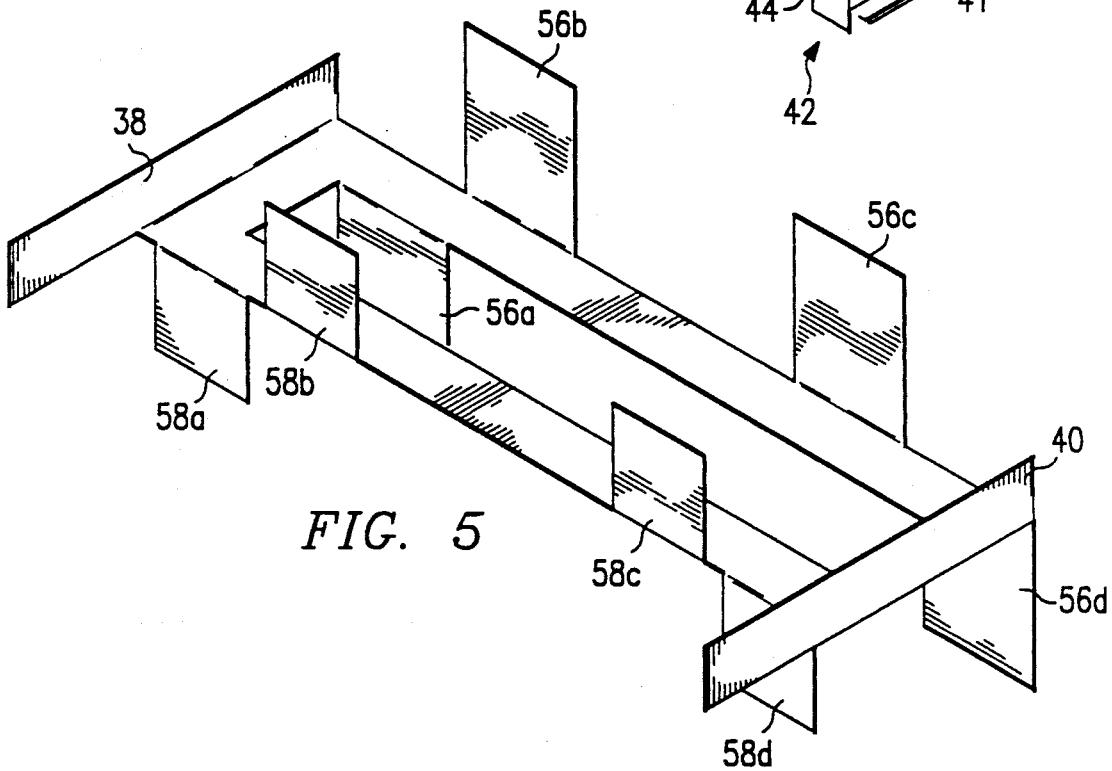
FIG. 5 is a perspective view of the spacer of FIG. 4 adapted for use in the wall construction.

FIGS. 4 and 5 show an alternate embodiment of the spacer according to the present invention. Spacer 52 comprises a base 54 having a cut-out portion 55. A plurality of tabs 56*a*–56*d* extend from one side of the spacer and a plurality of tabs 58*a*–58*d* extend from the opposite side. First and second support arms 38 and 40 extend from the sides of the spacer. Upon folding of the tabs 56 and 58 as shown in FIG. 5, the spacer is useful in aligning bricks as described above. In particular, tabs 56 are supported against the interior faces 24 of adjacent bricks and correspond to the base of the spacer described above in FIG. 2. Tabs 58 are then supported in the longitudinal grooves of the bricks.

It should be appreciated by those skilled in the art that the specific embodiments disclosed above may be readily utilized as a basis for modifying or designing other structures for carrying out the same purposes of the present invention. For example, a second set of longitudinal grooves can be formed in the top and bottom of each brick for receiving the base portion of each spacer. Such grooves would be parallel to the grooves 32 shown in FIG. 1 and would be located adjacent to the interior face 24. In this embodiment, the height of the base is decreased and is made substantially equal to the height of the tab 42. It should also be realized by those skilled in the art that such equivalent constructions do not depart from the spirit and scope of the invention as set forth in the appended claims.

What is claimed is:

1. A wall, comprising:

a plurality of blocks arranged in at least first and second layers spaced one above the other by a predetermined distance, each of the blocks having an exterior face, an interior face, a top and a bottom, the top and bottom of each block having a longitudinal groove located a predetermined distance from the interior face and adapted to be aligned with the grooves of adjacent blocks, wherein the tops of adjacent blocks in each layer are located in a common plane;

a plurality of spacers each having a base supported against the interior faces of adjacent blocks in the first layer, each spacer having first and second arms with each arm extending transversely from the base in a plane perpendicular to the common plane, each arm having an upper edge supported against the bottom of a block in the second layer and a lower edge supported against the top of a block in the first layer, each arm including at its distal end a tab having first and second portions, the first portion extending downwardly into the longitudinal groove of a block in the first layer and the second portion extending upwardly into the longitudinal groove of a block in the second layer; and a cementitious material located in the space between the first and second layers.

2. The wall as described in claim 1 wherein the first and second arms are cut-out portions of the base.

3. The wall as described in claim 1 wherein the spacer is formed of steel.

4. The wall as described in claim 1 wherein the spacer is formed of rigid cardboard.

5. The wall as described in claim 1 wherein each arm of the spacer is sized to correspond to a height of a mortar joint between layers.

6. The wall as described in claim 1 wherein at least one of the spacers includes a line of weakness along a mid-portion of the spacer to enable the spacer to be bent into first and second transverse sections.

7. The wall as described in claim 1 wherein each of the blocks is a brick.

8. A spacer for use in the construction of a wall comprising a plurality of blocks arranged in at least first and second layers spaced one above the other by a predetermined distance, each of the blocks having an exterior face, an interior face, a top and a bottom, the top and bottom of each block having a longitudinal groove located a predetermined distance from the interior face and adapted to be aligned with the grooves of adjacent blocks, wherein the tops of adjacent blocks in each layer are located in a common plane, comprising:

a base for support against the interior faces of adjacent blocks in the first layer; and first and second arms extending transversely from the base in a plane perpendicular to the common plane, each arm having an upper edge for supporting a bottom of a block in the second layer and a lower edge for supporting a top of the block in the first layer, each arm including at its distal end a tab having first and second portions, the first portion for extending downwardly into the longitudinal groove of a block in the first layer and the second portion for extending upwardly into the longitudinal groove of a block in the second layer.

9. The spacer as described in claim 8 wherein the first and second arms are cut-out portions of the base.

10. The spacer as described in claim 8 formed of steel.

11. The spacer as described in claim 8 formed of rigid cardboard.

12. The spacer as described in claim 8 wherein each arm is sized to correspond to a height of a mortar joint between layers.

13. The spacer as described in claim 8 further including a line of weakness along a mid-portion thereof to enable the spacer to be bent into first and second transverse sections.

14. A spacer for use in the construction of a wall comprising a plurality of blocks arranged in at least first and second layers spaced one above the other by a predetermined distance, each of the blocks having an exterior face, an interior face, a top and a bottom, the top and bottom of each block having alignment means located a predetermined distance from the interior face and adapted to be aligned with the alignment means of adjacent blocks, wherein the tops of adjacent blocks in each layer are located in a common plane, comprising:

a base for support against the interior faces of adjacent blocks;

at least one support arm extending transversely from the base in a plane perpendicular to the common plane, the arm having an upper edge for supporting a bottom of a block in the second layer and a lower edge for supporting a top of the block in the first layer such that a mortar joint is created between the first and second layers; and a tab located at a distal end of the support arm for being received in the alignment means of a block;

wherein the base includes a cut-out portion located adjacent to the mortar joint such that excess mortar can be removed through the cut-out portion during the wall construction.

* * * * *